United States Patent [19]

Nakayama et al.

[11] Patent Number: 4,695,533

[45] Date of Patent: Sep. 22, 1987

[54] SILVER HALIDE PHOTOGRAPHIC LIGHT-SENSITIVE MATERIAL

[75] Inventors: Noritaka Nakayama; Satoshi Kawakatsu; Katsunori Katoh, all Hachioji; Toshijumi Iijima, Kokubunji; Kenji Kumashiro, Hachioji; Hiroshi Kashiwagi, Hino; Koichi Hatta; Takashi Uchida, both of Hachioji; Hajime Wada, Tokyo; Fumio Ishii, Akishima; Satoshi Matsunaga, Hino; Yasuko Matsubara, Akishima; Kaoru Shinozaki, Tokyo, all of Japan

[73] Assignee: Konishiroku Photo Industry Co., Ltd., Japan

[21] Appl. No.: 845,881

[22] PCT Filed: Sep. 12, 1985

[86] PCT No.: PCT/JP85/00510

§ 371 Date: May 28, 1986

§ 102(e) Date: May 28, 1986

[87] PCT Pub. No.: WO86/01915

PCT Pub. Date: Mar. 27, 1986

[30] Foreign Application Priority Data

Sep. 14, 1984 [JP] Japan ..... 59-193609
Dec. 26, 1984 [JP] Japan ..... 59-281182
Apr. 3, 1985 [JP] Japan ..... 60-70197

[51] Int. Cl.[4] ..... G03C 1/40; G03C 7/38; G03C 7/32

[52] U.S. Cl. ..... 430/558; 430/386; 430/387; 430/551

[58] Field of Search ..... 430/558, 551, 372, 931, 430/554, 449, 386, 387

[56] References Cited

U.S. PATENT DOCUMENTS 4,585,732 4/1986 Kawagishi et al. ..... 430/558
4,607,002 8/1986 Nakayama et al. ..... 430/505

FOREIGN PATENT DOCUMENTS 0178789 4/1986 European Pat. Off. .

*Primary Examiner*—Richard L. Schilling
*Assistant Examiner*—Lee C. Wright
*Attorney, Agent, or Firm*—Finnegan, Henderson, Farabow, Garrett & Dunner

[57] ABSTRACT

This invention relates to a silver halide photographic light-sensitive material in which at least one of the silver halide emulsion layers thereof contains an 1H-pyrazolo[3,2-C]-s-triazole magenta coupler substituted in the third position by a group represented by the following Formula [I];

$$-R_1-SO_2-R_2 \qquad \text{Formula [I]}$$

wherein $R_1$ represents an alkylene group having not less than 3 carbon atoms in the straight-chained portion thereof, which is capable of linking a $-SO_2-R_2$ to the carbon atom in the third position of the nucleus of the 1H-pyrazolo[3,2-C]-s-triazole; and $R_2$ represents an aryl group.

The silver halide photographic light-sensitive materials of the invention are excellent in light-resistance of magenta dye images and also spectral absorption characteristics.

7 Claims, 4 Drawing Figures

SILVER HALIDE PHOTOGRAPHIC LIGHT-SENSITIVE MATERIAL

TECHNICAL FIELD

This invention relates to a silver halide photographic light-sensitive material containing magenta couplers capable of displaying both of the excellent color forming characteristics and the excellent preservability and forming magenta dye images particularly improved on the light-stability thereof and, more particularly to a silver halide color photographic light-sensitive material containing a novel magenta coupler of 1H-[3,2-C]-s-triazole type.

BACKGROUND ART

In a silver halide color photographic light-sensitive material, a dye image is ordinarily obtained in such a manner that silver halide particles exposed to light are reduced with an aromatic primary amine color developing agent, and the oxidation products of the color developing agent produced in the reduction process are coupled to the couplers capable of forming the respective yellow, magenta and cyan dyes.

A pyrazolone type coupler has so far been put in practical use to form the above-mentioned magenta dye. However, it has disadvantageous points that it causes an undesirable side absorption and it lacks the resistance against formalin gas (i.e., a formalin resistance).

In order to improve the above-mentioned disadvantages, there have so far been a variety of proposals of such magenta couplers of 1H-pyrazolo[3,2-C]-s-triazole type. For example, there are the descriptions thereof in U.S. Pat. No. 3,725,067; and British Pat. Nos. 1,252,418 and 1,334,515. The compounds described therein are superior of course to the magenta couplers of pyrazolone type as far as the problems of side absorption are concerned. however, they are not satisfactorily improved on the formalin resistance and are also scarcely improved on the light-stability of images.

The compounds described in Research Disclosure No. 12443 cannot also be put in practical use at all because of the poor color forming characteristics thereof. The magenta couplers of 1H-pyrazolo [3,2-C]-s-triazole type described in Japanese Patent Open to Public Inspection (hereinafter called Japanese patent O.P.I. Publication) No. 42045/1983 are remarkably improved on both of the formalin resistance and the color forming characteristics thereof, however, the light-stability thereof is not almost improved, too.

The couplers described in Japanese Patent O.P.I. Publication Nos. 99437/1984 and 125732/1984 have not any sign of the improvement as yet on the light-stability of dye images made of the described couplers, though they are improved on the color forming characteristics.

The latter is only i:proved on the light-stability of images by the additives used in combination. As an exception, the coupler given in Exemplified Compound 19 described in the former is somewhat improved on the light-stability, however, the improvement thereof is still no satisfactory.

On the other hand, Japanese Patent Application Nos. 243007/1984, 243008/1984, 243009/1984, 243010/1984, 243011/1984, 243012/1984, 243013/1984, 243014/1984 and 243015/1984 disclose the magenta couplers of 1H-pyrazolo[3,2-C]-s-triazole type of which color forming characteristics and the light-stability of the dye images thereby produced are improved.

However, in the magenta couplers described therein, the spectral absorption characteristics thereof are not satisfactory, while the color forming characteristics and the light-stability of the dye images thereby produced indicate the signs of improvements.

In other words, it is the present situation that, from among the magenta couplers of 1H-pyrazolo[3,2-C]-s-triazole type having occupied the attention because of no side absorption and high formalin resistance thereof none of those capable of satisfying the three points mentioned above, i.e., the color forming characteristics, the light-stability of dye images and the spectral absorption characteristics cannot be found out.

It is an object of the invention to provide a silver halide photographic light-sensitive material which is excellent in color forming characteristics of magenta dyes and in light-stability of dye images, and improved on the spectral absorption characteristics thereof.

DISCLOSURE OF THE INVENTION

The above-mentioned objects of the invention can be achieved by a silver halide photographic light-sensitive material comprising a support bearing thereon at least one silver halide emulsion layer, wherein at least one of the silver halide emulsion layers contains a magenta coupler of 1H-pyrazolo[3,2-C]-s-triazole type substituted a group represented by the following Formula [I]in the third position;

$$-R_1-SO_2-R_2 \qquad \text{Formula [I]}$$

wherein $R_1$ represents an alkylene group connecting carbon atom in the third position of 1H-pyrazolo[3,2-C]-s-triazole nucleus with $-SO_2$'1 $R_2$, and the number of carbon atoms in the straight chain portion of the alkylene group is not less than 3; and $R_2$ represents an aryl group.

In the groups each represented by the aforegiven Formula [I], $R_1$ represents an alkylene group having no less than 3 carbon atoms in the straight chain portion thereof. Such an alkylene group is allowed to have a straight chain or a branched chain, and is an alkylene group having no less than 3 carbon atoms in the straight chain portion, preferably having not less than 3 to not more than 6 carbon atoms therein, and more preferably having 3 or 4 carbon atoms therein. The alkylene group represented by $R_1$ is also allowed to have a substituent which includes, for example, an aryl group such as a phenyl group and the like, a halogen atom such as a chlorin atom. a fluorine atom and the like, an alkoxy group such as a methoxy group, an ethoxy group and the like, a cyano group, an alkoxycarbonyl group such as a methoxy carbonyl group and the like.

The preferable alkylene groups each represented by $R_1$ are given below;

$$-CH_2CH_2CH_2-,\quad -\underset{\displaystyle CH_2}{\underset{|}{CH}}CH_2CH_2-,$$

$$-\underset{\displaystyle C_2H_5}{\underset{|}{CH}}CH_2CH_2-,\quad -CH_2CH_2\underset{\displaystyle C_7H_{15}}{\underset{|}{CH}}-,$$

$$-CH_2CH_2\underset{\displaystyle C_2H_5}{\underset{|}{CH}}-,\quad -CH_2CH_2CH_2\underset{\displaystyle C_6H_{13}}{\underset{|}{CH}}-,$$

-continued $-CH_2CH_2CH_2CH_2-$, $-CHCH_2CH_2-$,

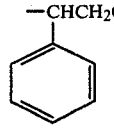

$-CH(CH_3)_2CH_2CH_2-$

In the aforegiven Formula [I], $R_2$ represents an aryl group, and the typical examples thereof include, for example, a phenyl group, a naphthyl group and the like, which are also allowed to have a substituent. Such substituents include, for example, a straight-chain or branched-chain alkyl group such as a methyl group, an n-butyl group, a t-butyl group, a t-pentyl group, a t-octyl group, a dodecyl group and the like; an alkoxy group such as a methoxy group, a buthoxy group, a dodecyloxy group and the like; a halogen atom such as a chlorine atom, a bromine atom and the like; an acylamino group such as a methoxyamino group, a buthoxyamino group and the like: a diacylamino group such as a methoxymethoxyamino group, a methoxyethoxyamino group and the like; an imido group such as a succineimido group and the like; a sulfoamido group; an alkoxycarbonyl group such as a methoxycarbonyl group and the like; a carbamoyl group; an acyl group such as an acetyl group and the like; and the like. Such an aryl group represented by $R_2$ is allowed to have no less than two of the above-mentioned substituents, and in such cases the substituents are allowed to be the same or different from each other.

The magenta couplers of 1H-pyrazolo3,2-C]-s-triazole type of the invention substituted with the groups represented by the aforegiven Formula [I]are preferably represented by the following Formula [II];

Formula [II]

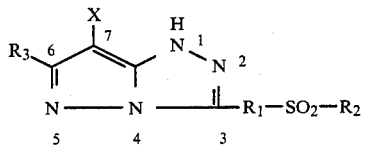

wherein $-R_1-SO_2-R_2$ represents a group represented by the aforegiven Formula [I]; $R_3$ represents an alkyl group, a cycloalkyl group, an aryl group, or a heterocyclic group; and X represents a group to be splitted off through a reaction with the oxidation products of a color developing agent, and it does not contain any hydrogen.

In the abovegiven Formula [II], the alkyl groups represented by $R_3$, which are to be substituted to the 6th position include, for example, a primary, secondary or tertiary alkyl group. The primary alkyl groups are the alkyl groups including, for example, a methyl group, an ethyl group or the like, in which at least two hydrogen atoms are bonded to the route carbon atom of the alkyl group in the 6th position indicated in the Formula [II]. The secondary alkyl groups are the alkyl groups including, for example, an i-propyl group, a sec-butyl group or the like, in which one hydrogen atom is bonded to the route carbon atom of the alkyl group which is to be bonded to the carbon atom in the 6th position. The tertiary alkyl groups are the alkyl groups in which no hydrogen atom is bonded to the route carbon atom of the alkyl group which is to be bonded to the carbon atom in the 6th position, and they include, for example, a t-butyl group, a t-pentyl group or the like.

The cycloalkyl groups each represented by $R_3$ include, for example, a cyclohexyl group and the like.

A preferable example of the aryl groups represented by $R_3$ is a phenyl group.

The heterocyclic groups each represented by $R_3$ include, for example, a furan ring group, a thiophene ring group and the like.

In the abovegiven Formula [II], the groups which are represented by X to be substituted in the 7th position and to be splitted off through a reaction with the oxidation products of a color developing agent include, for example, a halogen atom such as a chlorine atom, a bromine atom or, an organic groups each coupled to the 7th coupling position with an oxygen atom, a nitrogen atom or sulfur atom.

To be more detailedly described of the organic groups coupled to the 7th coupling position with an oxygen atom or a sulfur atom, the organic groups each coupled to a coupling position with an oxygen atom include, for example, an alkoxy group, an aryloxy group, an acyloxy group, a heterocyclic oxy group and the like; the organic groups coupled to a coupling position with a nitrogen atom include, for example, an; acylamino group, a diacylamino group, a sulfonamide group, and a 5-membered or 6-membered heterocyclic group containing the nitrogen atom thereof, Further, the organic groups each coupled to a coupling position with a sulfur atom include, For example, a thiocyano group, an alkylthio group, an arylthio group, a heterocylic thio group, and arylsulfonyl group, an alkylsulfonyl group and the like.

The typical examples of 1H-pyrazolo[3,2-C]-s-triazole type capable of being used in the invention are given below, and it is, however, to be understood that the invention shall not be limited thereto.

Exemplified Magenta Couplers:

(1)

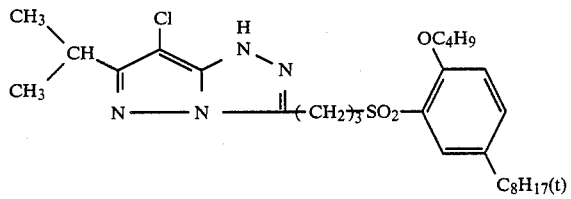

-continued
Exemplified Magenta Couplers:
(2)
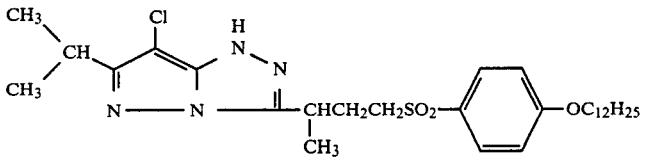
(3)
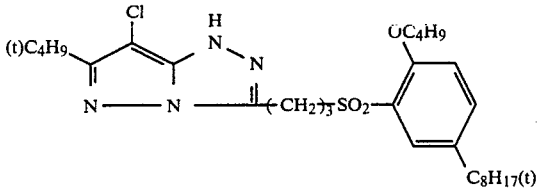
(4)
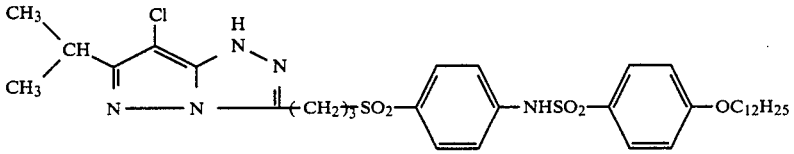
(5)
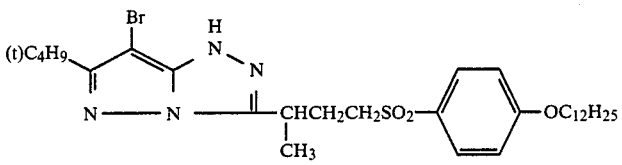
(6)
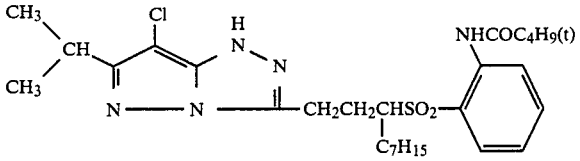
(7)
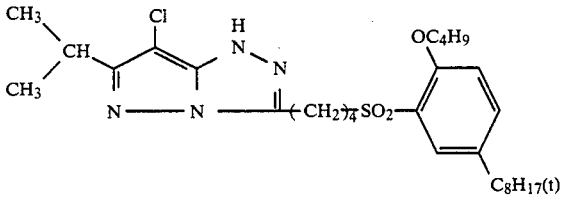
(8)
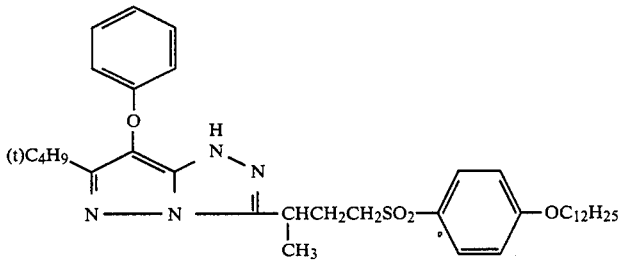
(9)
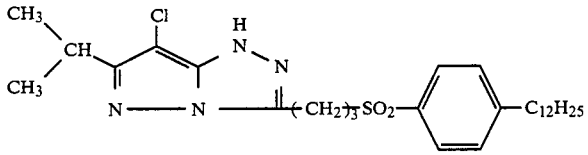

-continued
Exemplified Magenta Couplers:
(10)
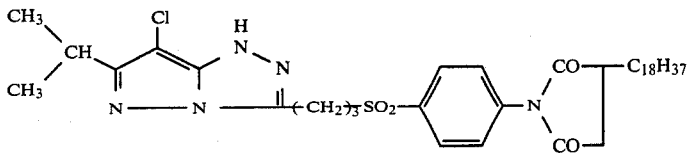
(11)
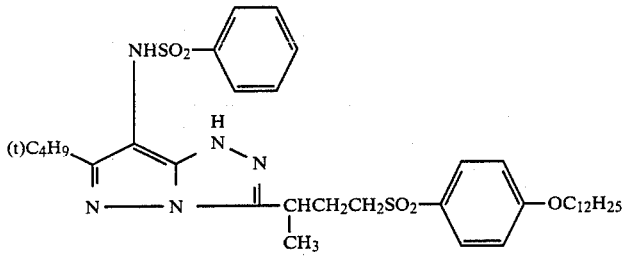
(12)
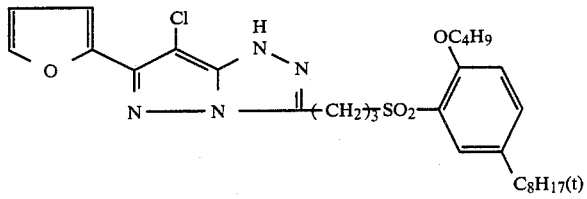
(13)
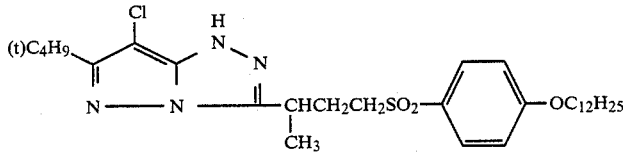
(14)
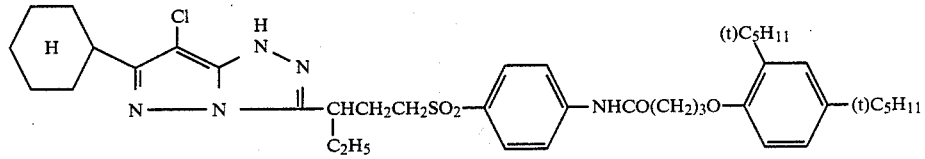
(15)
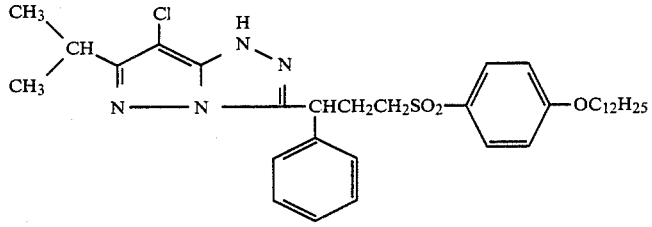
(16)
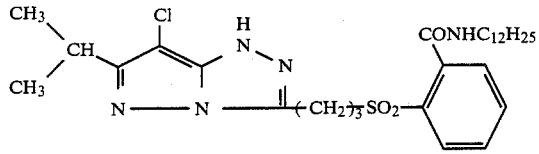
(17)
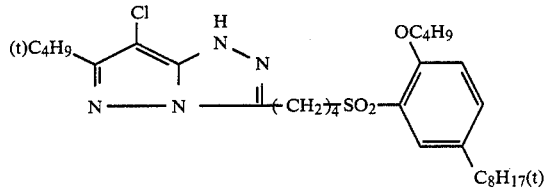

-continued
Exemplified Magenta Couplers:
(18)
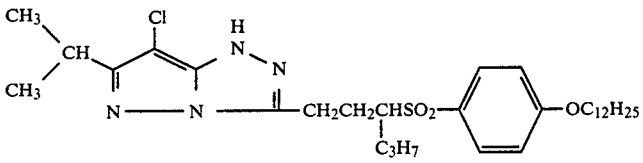
(19)
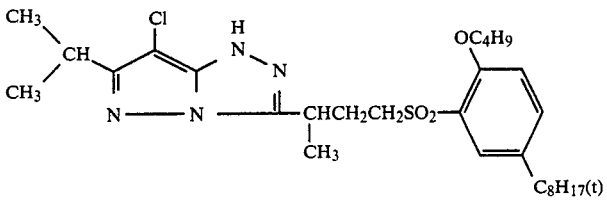
(20)
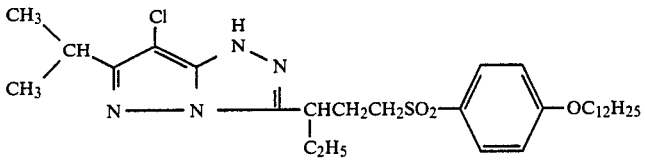
(21)
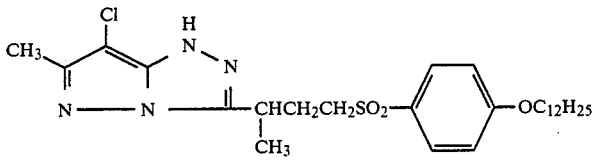
(22)
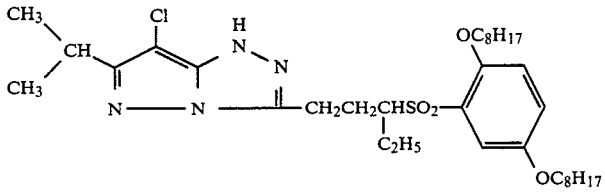
(23)
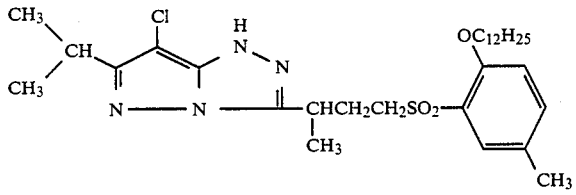
(24)
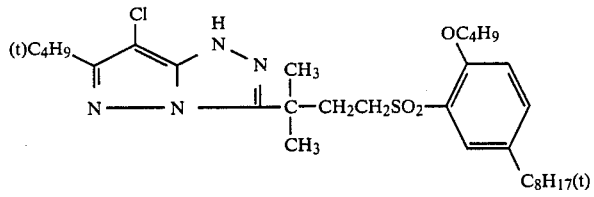
(25)
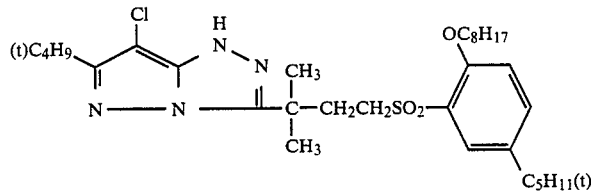

-continued

Exemplified Magenta Couplers:

(26)

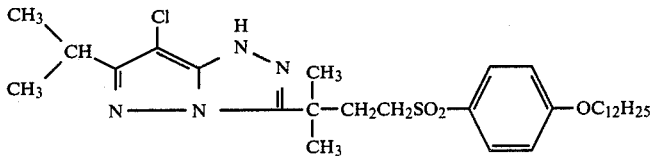

(27)

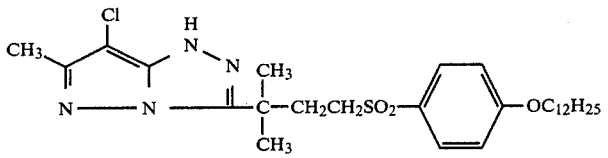

(28)

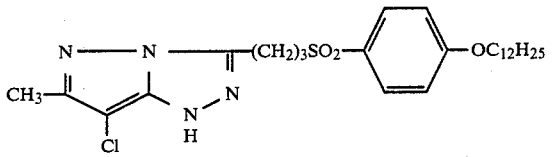

(29)

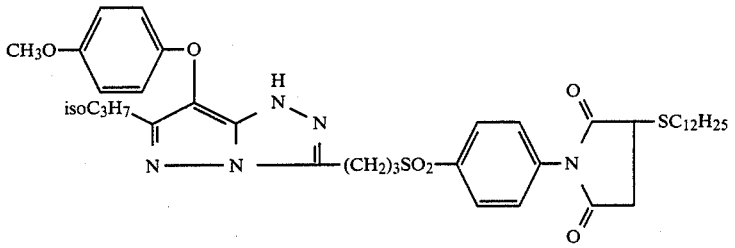

Next, the synthesizing process of the magenta couplers of 1H-pyrazolo[3,2-C]-s-triazole type of the invention will now be described.

The groups of the invention each represented by the aforegiven Formula [I, ] that is, —$R_1$—$SO_2$—$R_2$, are required to synthesize in advance the corresponding $R_2$—$SO_2$—$R_1$—COOH which can be prepared by oxidizing $R_2$—S—$R_1$—COOH with hydrogen peroxide in accordance with the process described in Japanese Patent O.P.I. Publication No. 24321/1972.

After the preparation of $R_2$—$SO_2$—$R_1$—COOH, 1[H-pyrazolo 3,2-C]-s-triazole is synthesized with reference to Research Disclosure No. 12443 and Journal of the Chemical Society, Perkin I, i1977, 2047–2052. The split-off group is further introduced into the 7th position with reference to U.S. Pat. No. 3,725,067 and Japanese Patent O.P.I. Publication No. 99437/1984, respectively.

The typical synthesis examples are described below:

SYNTHESIS EXAMPLE 1

Synthesis of Exemplified Magenta Coupler (1)

(1) Synthesis of γ-(2-buthoxy-5-t-octylphenylthio)-butyric acid:

A dissolution of 29.4 g of 2-buthoxy-5-t-octyl-phenylmercaptan and 8.6 g of γ-butyrolactone was made in 100ml dimethylformamide, and 20 g of sodium methylate were added therein. The resulted solution was heated and stirred for a couple of hours at 80° C. After a reaction, the reactant was poured into water and was then acidified with hydrochloric acid. The deposited crystals were taken out through a filtration and were then washed with methanol, so that the almost purified objects were obtained.

(2) Synthesis of γ-(2-buthoxy-5-t-octyl-phenylsulfonyl)-butyric acid:

A dissolution of 35.6 g of γ-(2-buthoxy-5-t-octyl-phenylsulfonylthio)butyric acid was made in 90 ml of acetic acid, and 31.8 of a 30% hydrogen peroxide solution were dropped thereinto at 50° C. to 60° C. Thereafter, the resulted matter was heated for two hours at 100° C. After cooling, the deposited crystals were taken out through a filtration, and were then washed well with hexane, so that an almost pure object was obtained.

(3) Synthesis of

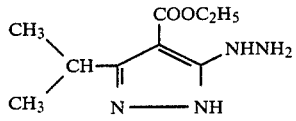

This synthesis was made with reference to the process described in Journal of the Chemical Society, Perkin I. 1977, 2077–2052.

(4) Synthesis of

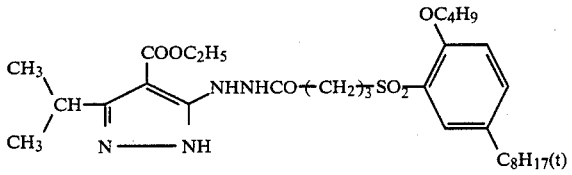

A dispersion of 10.6 g of the hydrazine derivative obtained in the above-mentioned synthesis (3) was made in 100 ml of acetonitrile, and 6.4 g of triethylamine were added thereto. The resulted solution was added dropwise with a solution prepared by dissolving an acid chloride obtained from 2.17 g of the acid obtained in the synthesis (2) into a small amount of acetonitrile. Thereafter, the reslted matter was refluxed for 30 minutes. The acetonitrile was distilled off and the remaining matter was poured into water and was then extracted with ethyl acetate. After extracting the ethyl acetate, the residues were refined in a column chromatographic method, so that the object matter in the form of light brown colored powders was obtained.

(5) Synthesis of

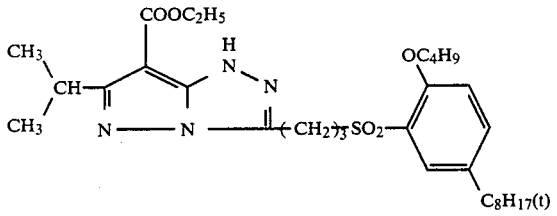

A dissolution of 22.5 g of the synthesized matter obtained in the above-mentioned (4) was made in toluene, and 6.0 g of phosphorous oxychloride were added thereto, and the resulted solution was boiled for two and a half hours. Thereafter, 9.8 g of triethylamine were added and boiled for 15 minutes. Then, toluene was distilled off. And the resulted residues were dissolved in ethyl acetate and were then washed well. The ethyl acetate was distilled off, and the resulted residues were refined in a column chromatographic process.

(6) Synthesis of

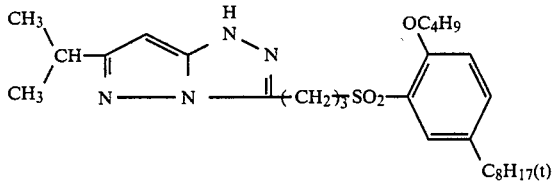

A mixture solution of 6 ml of concentrated sulfuric acid, 35 ml of glacial acetic acid and 3 ml of water was added with 7.1 g of the synthesized matter obtained in the above-mentioned synthesis (5). and the resulted solution was boiled for six hours. Therefrom, acetic acid was distilled off, and the resulted residues were poured into water and were then neutralized with caustic soda. The resulted matter was extracted with ethyl acetate and was then washed well. The ethyl acetate was distilled off, so that the almost pure object matter was obtained.

(7) Synthesis of Exemplified Magenta Coupler (1):

A dissolution of 5.7 g of the synthesized matter obtained in the synthesis (6) was made in chloroform, and 1.4 g of N-chlorosuccinimide were added thereto be reacted for an hour at room temperature. The reacted liquid was then washed with a diluted alkali solution and washed further with water. Chloroform was distilled off therefrom, and the resulted residues were refined in a column chromatographic process, so that the object matter in the form of colorless powders. The object matter was confirmed by making use of nuclear magnetic resonance spectra.

The magenta couplers of the invention other than the above-mentioned exemplified magenta couplers can be synthesized in accordance with the above-mentioned examples. Besides the above, the split-off groups other than chlorine atom were introduced thereinto with reference to U.S. Pat. No. 3,725,067 and Japanese Patent O.P.I. Publication No. 99437/1984.

An amount of the magenta couplers relating to the invention to be added in a photographic light-sensitive material of the invention is preferably within the range of from $1.5\times10^{-3}$ mole to $7.5\times10^{-1}$ mole and more preferably from $1\times10^{-2}$ mole to $5\times10^{-1}$ mole, per mole of silver.

The silver halide photographic light-sensitive materials of the invention may include, for example, a color-negative film, a color positive film, a color printing paper, and the like. In particular, the effects of the processes of the invention can be displayed more advantageously when the invention is applied to the color printing paper being served directly for appreciation.

The silver halide photographic light-sensitive materials, such a color printing paper as mentioned above included, may be for monochromatic use or for multichromatic use. In the latter case, such a multicolor silver halide photographic light-sensitive material usually has such a structure that the support thereof is laminated thereon with non-light-sensitive layers and silver halide emulsion layers containing a magenta couplers, a yellow coupler and a cyan coupler respectively to serve as the photographic couplers so as to reproduce colors in a substractive color photographic process in a suitable number and order of the layers which may suitable be changed according to the purposes of the use and to what characteristics to be emphasized.

For the silver halide emulsions to be used in the silver halide photographic light-sensitive materials of the invention, there may be used any one of the silver halide emulsions which are usually used, such as those of silver bromide, silver iodobromide, silver iodochloride. silver chlorobromide, silver chloride or the like.

The silver halide particles to be used in the silver halide emulsions of the invention are allowed to prepare in any one of an acid process, a neutral process and an ammoniacal process. Such particles may be grown either at a time or after producing the seed particles thereof. The processes each of producing and growing such seed particles may be either the same or the different.

In the silver halide emulsions, it is also allowed that a halogen ion and silver ion are mixed up at the same time, or that one of them is mixed up in a matter in presence of the other. The particles may also be produced by adding halide ions and silver ions gradually and at the same time with controlling the pH and pAg in a mixing furnace, by taking the critical growth rate of silver halide crystals into consideration. After the growth thereof, it is also allowed to change the halogen composition of the particles by applying a conversion process.

In the course of manufacturing the silver halide emulsions of the invention, it is possible to control the sizes, configuration, size distribution and growth rate of silver halide particles by making use of a silver halide solvent if occasion demands.

The silver halide particles to be used in the silver halide emulsions of the invention may contain metal ions inside of the particles and/or inside of the surfaces thereof, in the process of forming the particles and/or in the process of growing the particles, by making use of a cadmium salt, a zinc salt, a lead salt, a thallium salt, an fridium salt or the complex salts thereof, a rhodium salt or the complex salts thereof, or an iron salt or the complex salts thereof; and the particles may be endowed inside thereof and/or inside of the surfaces thereof with reduction sensitization nuclei, by placing the particles in a suitable reducible atomosphere.

After the completion of the growth of the silver halide particles, it is allowed to remove unnecessary soluble salts therefrom or to contain such soluble salts as they are. If such salts are to be removed, it may be carried out in accordance with the process described in Research Disclosure. 17643.

The inside and the surfaces of the silver halide particles to be used in the silver halide emulsions of the invention are allowed to comprise uniform or different layers.

The silver halide particles to be used in the silver halide emulsions of the invention are allowed to be those forming a latent image mainly on the surfaces thereof, or mainly inside thereof.

The silver halide particles to be used in the silver halide emulsions of the invention are allowed to be in the regular crystal configuration or in the irregular crystal configuration such as a globular or plate-like configuration. In these particles, any rate of a [1,0,0] face to a [1,1,1] face may be applied. Also, any composite crystal configuration and the mixtures of variously crystallized particles are allowed to use.

A mixture of no less than two kinds of silver halide emulsions separately prepared may also be used for the silver halide emulsions of the invention.

The silver halide emulsions of the invention are chemically sensitized in an ordinary process. Namely, a sulfur sensitization using a sulfur-containing compound capable of reacting with silver ions, or using an active gelatin; a reduction sensitization using a reducible substance; a noble-metal sensitization using gold or other noble-metal compounds; and the like, may be used independently or in combination.

The silver halide emulsions of the invention may be optically sensitized up to a desired wavelength region, by making use of the dyes which are well known as sensitizing dyes in the photographic industry. Such sensitizing dyes may be used independently or in combination. Such emulsions are also allowed to contain dyes having no spectral sensitizing function in themselves, or a color-supersensitizer that is a compound substantially incapable of absorbing visible rays of light for increasing the sensitizing functions of a sensitizing dyes, as well as the above-mentioned sensitizing dyes.

There may be added the compound which are well-known in the photographic industry as the antifoggant or the stabilizer into the silver halide emulsions of the invention during the chemical ripening and/or upon completing the chemical ripening and/or after completing the chemical ripening, before coating the silver halide emulsions, with the purposes of preventing fogs which may occur in the course of the manufacturing processes, preservation or photographic processes of a light-sensitive material, and/or keeping the photographic characteristics thereof stable.

As for the binders or the protective colloids of the silver halide emulsions of the invention, gelatins are advantageously used, and besides, a hydrophilic colloid such as a gelatin derivative, a graft-polymer of gelatin and the other high molecule, a protein, a succharide derivative. a cellulose derivative, or a synthetic hydrophilic high-molecular substance such as a single polymer or a copolymer may also be used for.

The photographic emulsion layers and the other hydrophilic colloidal layers of the light-sensitive materials in which the silver halide emulsions of the invention are used may be hardened by coupling the molecules of the binders or the protective colloids thereof and using independently or in combination a hardening agent for increasing the hardness of the layers. It is desired that the hardening agent is to be added in an amount of capable of hardening a light-sensitive material to the extent that another hardening agent is not necessary tc add in a processing liquid. It is also possible to add a hardening agent into a processing liquid.

A plasticizer may also be added to the silver halide emulsion layers and/or the other hydrophilic colloidal layers of the light-sensitive materials in which the silver halide emulsions of the invention are used, for the purpose of increasing the softness of such layers.

The photographic emulsion layers and other hydrophilic colloidal layers of the light-sensitive materials in which the silver halide emulsions of the invention are used may also contain the dispersed matter, i.e., the latex, of a water-insoluble or a hardly soluble synthetic polymers, for the purposes of improving the dimensional stability of such layers and the like.

There uses a color dye forming coupler in the emulsion layers of the silver halide color photographic light-sensitive materials of the invention so that the color dye forming couplers may be able to form the dyes through a coupling reaction with the oxidation products of an aromatic primary amine developer such as a p-phenylenediamine derivative or an aminophenol derivative, in a color developing process. Such dye-formable couplers are ordinarily selected so as to form the dyes capable of absorbing the spectra of each emulsion layer, respectively. Yellow-dye formable couplers are to be used in a blue-light-sensitive emulsion layer, magenta-dye formable couplers are used in a green-light-sensitive emulsion layer, and cyan-dye formable couplers are used in a red-light-sensitive emulsion layer. Nevertheless, a silver halide color photographic light-sensitive material may also be prepared in the different way from the above-mentioned combination according to the purposes of the use.

Such yellow-dye formable couplers include, for example, an acylacetamide coupler such as those of a benzoylacetanilide or those of a pivaloylacetanilide; the magenta-dye formable couplers include, for example, 5-pyrazolone couplers, pyrazolobenzimidazole couplers, pyrazolotriazole couplers, open-chained acylacetaonitrile couplers and the like; and the cyan-dye formable couplers include, for example, naphthol couplers, phenol couplers and the like.

It is desired that the above-mentioned dye formable couplers are to have a group having not less than 8 carbon atoms capable of making couplers non-dispersed, that is so-called a ballast group. These dye formable couplers may be of 4-equivalent type in which 4-molecular silver ions are required to reduce for forming signal moleclar dyes. or may also be of Z-equivalent type in which only 2-molecular silver ions are satisfactorily reduced.

Hydrophobic compounds such as a dye formable coupler and the like which are unnecessary for adsorbing them on the surfaces of silver halide crystals may be treated in a solid dispersion method, a latex dispersion method, an oil drops-in-water type emulsification-dispersion method and the like. These methods may suitably be selected according to the chemical structures of such a hydrophobic compound as a coupler. A method of dispersing such a hydrophobic compound as a coupler or the like may be applied to the oil drops-in-water type emulsification-dispersion method. To be more concrete, such hydrophobic compound as couplers are dissolved in a high boiling organic solvent having a boiling point of about not lower than 10° C. and, if required, in combination of a low boiling and/or water soluble organic solvent. and the resulted solution is added with a hydrophilic binder such as an aqueous gelatin solution and with a surfactant, so that an emulsification-dispersion is made by making use of a dispersing means such as an agitator, a homogenizer, a colloid-mill, a flow jet mixer, a supersonic wave generator or the like, and the resulted matter is then added to a hydrophilic colloidal layer that is an object. In the above-mentioned process, it is allowed to add a process of removing the dispersing liquid or the low boiling organic solvent at the same time when dispersing.

The high boiling solvents capable of being used therein include, for example, those having a boiling point of not lower than 0° C., such as a phenol derivative, a phthalic acid ester, a phosphoric acid ester, a citric acid ester, a benzoic acid ester, an alkylamide, an aliphatic acid ester, a trimesic acid ester, or the like, which are unable to react with the oxidation product of a developing agent.

When a hydrophobic compound is dissolved in an independent low boiling solvent or in a solvent of a low and a high boiling solvents in combination and the resulting solution is to be dispersed in water by making use of a mechanical means or ultrasonic waves, an anionic, nonionic or cationic surfactant may be used to serve as a dispersing assistant.

Color fog inhabitors are used for preventing a color containation. a sharpness deterioration and a rough graininess caused by moving the oxidation products of a developing agent or an electron-transferring agent between the emulsion layers (i.e., between the same color sensitive layers and/or between the different color-sensitive layers) of a color photographic light-sensitive material of the invention.

Such color fog inhibitors may be incorporated into an emulsion layer itself, or may also be incorporated into an interlayer interposed between the adjacent emulsion layers.

An image stabilizer for preventing a dye image from deteriorating may be used in the color light-sensitive materials using the silver halide emulsions of the invention.

The hydrophilic colloidal layers such as a protective layer, an interlayer or the like of the light-sensitive materials of the invention are allowed to contain an ultraviolet ray absorbing agent so as to prevent the light-sensitive materials from occurring a fog caused by a discharge from the light-sensitive materials charged by a friction or the like, or from occurring a deterioration caused by ultraviolet rays emitted from an image.

The color light-sensitive materials using the silver halide emulsions of the invention may be provided with such an auxiliary layer as a filter layer, an antihalation layer and/or an antiirradiation layer. The above-mentioned layers and/or the emulsion layers are also allowed to contain the dyes capable of fluxing from the color light-sensitive material or the dyes capable of being bleached, in the course of the development process.

With the purposes of reducing gloss. improving a writing smoothness, preventing the adhesion of light-sensitive materials to each other and the like, a matting agent may be added into the silver halide emulsion layers and/or the other hydrophilic colloidal layers of the silver halide light-sensitive materials each using the silver halide emulsions of the invention.

A lubricant may also be added thereto so as to reduce the sliding friction of the light-sensitive materials using the silver halide emulsions of the invention.

With the purpose of preventing an electric charge an antistatic agent may also be added into the light-sensitive materials using the silver halide emulsions of the invention.

Such antistatic agents are used in one case in an antistatic layer on the side of a support where no emulsion is coated, and in the other case in a protective layer other than the emulsion layers on the side of the emulsion layers and or the suppport where the emulsion layers are laminated.

With the purposes of improving the sliding property, the coating property and the photographic characteristics such as a development acceleration, a contrast increase, a sensitization and the like, and preventing a static charge and an adhesion, and further emulsifying-dispersing the emulsions, various types of surfactants may be used in the photographic emulsion layers and/or the other hydrophilic colloidal layers of the light-sensitive materials using the silver halide emulsions of the invention.

In the light-sensitive materials using the silver halide emulsions of the invention, the photographic emulsion layers and/or the other layers thereof can be coated on a paper sheet such as a baryta layer-coated or an α-olefinpolymer-coated paper; a flexible reflective support such as a synthetic paper; a film sheet comprising a semisynthetic or synthetic marcropolymer such as cellulose acetate, cellulose nitrate, polystyrene, polyvinyl chloride, polyethylene terephthalate, polycarbonate, polyamide or the like; a rigid matter such as a glass plate, a metal, an earthware; or the like.

The silver halide materials of the invention may also be coated over to the surface of a support directly or with the interposition of one or not less than two undercoating layers for improving the adhesiveness of the support surface, an antistatic property; a dimensional stability, a wear-out resistance, a hardness, an antihalation property, a frictional property and/or the other properties, after the surface of the support is treated with a corona-discharge, an ultraviolet rays irradiation, a flame treatment or the like, if required.

When coating the photographic light-sensitive materials using the silver halide emulsions of the invention, a thickening agent may also be used so as to improve the coating property. The particularly useful coating methods are an extrusion coating method and a curtain-coating method each in which no less than two kinds of layers can be coated at one time.

The light-sensitive materials of the invention may be exposed to light by making use of the electromagnetic waves of the spectral region covering the sensitivity of the emulsion layers forming the light-sensitive material of the invention. The light sources capable of being used therein include, any one of the well-known light sources such as a natural light, i.e., sunlight, a tungsten lamp, a fluorescent lamp, a mercury lamp, a xenon arc lamp, a carbon arc lamp, a xenon flash lamp, a cathode-ray tube flying spot, a variety of laser-beams, an emission diode light, a light emitted from a phosphor excited by an electron-beam, X-rays, $\gamma$-rays, $\alpha$-rays or the like.

The applicable exposure time include, for example, not only an exposure of from 1 millisecond to 1 second for which photographs are taken with the ordinary types of cameras, but also an exposure of not longer than 1 millisecond such as an exposure of from 100 microseconds to 1 microsecond which is to be made by a cathode-ray-tube or a xenon flash lamp; and besides, an exposure of not shorter than 1 second can also be applicable. The above-mentioned exposures may be made continuously or intermittently.

With the silver halide photographic light-sensitive materials of the invention, an image can be formed by carrying out a color development process which has been well-known in the art.

The aromatic primary amine color developing agents which are to be used in the color developers in the invention include the publicly known ones being popularly used in a variety of color photographic processes. These developing chemicals include an aminophenol or a p-phenylenediamine derivative. These compounds are used in general in the form of a salt, such as a hydrochloride or a sulfate, so as to keep it more stabler than in a free state. These compounds are generally used in a concentration of from about 0.1 g to about 30 g per liter of a color developer, and more preferably from about 1 g to bout 1.5 g per liter or the developer used.

The aminophenol developers include, for example, o-aminophenol, p-aminophenol, 5-amino-2-oxytoluene, 2-aino-3-oxytoluene, 2-oxy-3-amino-1,4-dimethylbenzene, and the like.

The particularly useful aromatic primary amine color developers are N,N'-dialkyl-p-phenylenediamine compounds in which the alkyl group and the phenyl group may be substituted by any substituent. The more particularly useful ones include, for example, an N,N'-diethyl-p-phenylenediamine hydrochloride, a N-methyl-p-phenylenediamine hydrochloride, a N,N'-dimethyl-p-phenylenediamine hydrochloride, a 2-amino-5-(N-ethyl-N-dodecylamino)-toluene, an N-ethyl-N-$\beta$-methanesulfonamidoethyl-3-methyl-4-aminoaniline sulfonate, an N-ethyl-N-$\beta$-hydroxyethylaminoaniline, a 4-amino-N-(2-methoxyethyl)-N-ethyl-3-methylaniline-p-toluenesulfonate, and the like.

The color developers which are to be used in the processes of the invention are allowed to arbitrarily contain, besides the above-mentioned aromatic primary amine color developing chemicals, a variety of components having usually been added in such a color developer as described above, including, for example, an alkalifying agent such as sodium hydroxide, sodium carbonate, potassium carbonate and the like, an alkali metal sulfite, an alkali metal hydrogensulfite, an alkali metal thiocyanate, an alkali metal halide, benzyl alcohol, a water softener, a thickening agent and the like.

The pH values of these color developers are normally not lower than 7, and most generally from about 10 to about 13.

In the processes of the invention, a color development is carried out and a processing liquid having a fixing capacity is then used to process. When such processing liquid having a fixing capacity is a fixer, a bleaching process is carried out before the fixer is used. As for the bleaching agent, a metal complex salt of an organic acid is used. Such a metal complex salt has the functions that the metallic silver produced by the development is changed back into a silver halide through the oxidation process. and at the same time, the undeveloped color sections of a color developing chemical are color developed. The metal complex salts comprise an aminopolycarboxylic acid or an organic acid such as oxalic acid, citric acid or the like to which the ions of such a metal as iron, cobalt, copper or the like are coordinated. The most desirable organic acids for forming such metal complex salts of organic acids as mentioned above include, for example, a polycarboxylic acid or an aminopolycarboxylic acid. These acids may also be an alkali metal salt, an ammonium salt or a water-soluble amine salt.

The typical examples of these organic acids are given below:

[1] Ethylenediaminetetraacetic acid
[2] Nitrilotriacetic acid
[3] Iminodiacetic acid
[4] Disodiumethylenediaminetetraacetic acid
[5] Tetra- or Trimethyl ammonium ethylenediaminetetraacetate
[6] Tetrasodium ethylenediaminetetraacetate The bleaching agents to be used therein may contain a variety of additives as well as such an organic acid metal complex salt as given above. It is desired that the additives are to contain, in particular, an alkali halide or an ammonium halide including, for example, such a rehalogenizing agent as potassium bromide, sodium bromide, sodium chloride, ammonium bromide and the like, a metal salt and a chelating agent.

There may also suitably be added with a pH buffer such as a borate, an oxalate, an acetate, a carbonate, a phosphate or the like, and those of an alkylamine, a polyethylene oxide or the like which are well-known to be added usually into a bleaching agent.

In addition, the fixers and the bleaching-fixing liquids are allowed to contain a single or not less than two kinds of the pH buffers each comprising a sulfite such as ammonium sulfite, potassium sulfite, ammonium hydrogensulfite, potassium hydrogensulfite, sodium hydrogensulfite, ammonium metahydrogensulfite, potassium metahydrogensulfite, sodium metahydrogensulfite and the like; the pH buffers each comprising various salts such as sodium hydroxide, potassium hydroxide, sodium carbonate, potassium carbonate, sodium hydrogensulfite, sodium hydrogencarbonate, potassium hydrogencarbonate, sodium acetate, ammonium hydroxide and the like; boric acid, borax, and acetic acid.

When a process of the invention is carried out with replenishing a bleach-fix replenisher into a bleach-fixing liquid or bath, the bleach-fixing liquid or bath is allowed to contain a thiosulfate. a thiocyanate, a sulfite or the like, or the bleach-fixing replenisher is allowed to be replenished into a processing liquid after containing the above-mentioned salts.

With the purpose of increasing the activity of a bleach-fixing liquid in the invention, air or oxygen may be blown; if desired, into the bleach-fixing bath or the reservoir of the bleach-fixing replenisher, or a suitable oxidizing agent such as hydrogen peroxide, a bromic acid salt, a persulfate or the like may also be added thereinto.

[EXAMPLE]

Next, the invention will now be detailedly described with reference to the examples thereof, and it is. however, to be understood that the invention shall not be limited thereto.

[Example-1]

The magenta couplers of the invention and the comparative couplers such as shown in Table 1 were taken in an amount of 0.1 mole per mole of silver, respectively, and dibutyl phthalate of one time the amount by weight of the couplers and ethyl acetate of three ties the amount by weight of the couplers were added thereto. The resulted matters were completely dissolved by heating at 60° C. The resulted solutions were mixed with 1200 ml of an aqueous solution of 5% gelatin containing 120 of an aqueous solution of 5% alkylnaphthalene sulfonate (Alkanol B manufactured by DuPont) respectively, and the mixtures were emulsified and dispersed by means of an ultrasonic homogenizer, so that the emulsified matters were obtained, respectively.

Then, Samples No. 1 through No. 10 were prepared in such a manner that each of the obtained dispersed liquids was added respectively to 4 kg of a green-sensitive silver chlorobromide emulsion containing silver bromide of 80mole %, and 120 ml of an aqueous solution (water:methanol=1:1) of 2% 1,2-bis(vinylsulfonyl)ethane were added thereto to serve as a hardener. The resulted emulsions were coated on paper-made supports laminated on the both sides thereof with polyethylene, and dried, respectively. (The amount of silver coated: 5 mg/100 $cm^2$)

The samples thus obtained were exposed to light through wedges in an ordinary method, and the following developing steps were applied thereto, respectively. The results therefrom are shown in Table 1.

| <Developing Steps> | Temperature | Time | |
|---|---|---|---|
| Color development | 38° C. | 3 min. | 30 sec. |
| Bleaching-fixing | 33° C. | 1 | 30 |
| Stabilizing or washing | 25~30° C. | 3 | — |
| Drying | 75~80° C. | 2 approx. | |

In the above-mentioned steps each, the composition of each processing liquids used are as follows:

| <Color Developer> | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N—ethyl-N—(β-methanesulfonamidoethyl)-aniline sulfonate | 5.5 g |
| Optical brightening agent (4.4'-diaminostilbene sulfonic acid derivative) | 1.0 g |
| Potassium hydroxide | 2.0 g |
| Add water to make 1 liter in total, and adjust the pH value to pH 10.20. | |
| <Bleach-fixer> | |
| Iron(II) ammonium ethylenediamine-tetraacetate, dihydride | 60.0 g |
| Ethylenediaminetetraacetic acid | 3.0 g |
| Ammonium thiosulfate (a 70% solution) | 100 ml |
| Ammonium sulfite (a 40% solution) | 27.5 ml |
| Adjust the pH value to pH 7.1 with potassium carbonate or glacial acetic acid, and add water to make 1 liter in total. | |
| <Stabilizer> | |
| 5-chloro-2-methyl-4-isothiazoline-3-one | 1.0 g |
| Ethylene glycol | 10.0 g |
| 1-hydroxyethylidene-1,1'diphosphoric acid | 2.5 g |
| Bismuth chloride | 0.2 g |
| Ammonium hydroxide (a 28% solution) | 2.0 g |
| Sodium nitrilotriacetic acid | 1.0 g |
| Add water to make 1 liter in total, and adjust the pH value to pH 7.0 with ammonium hydroxide or sulfuric acid. | |

TABLE 1

| Sample No. | Coupler Used | Relative Sensitivity | Max. Density | λmax | D(λs) | D($\lambda_L$) | Light Resistance |
|---|---|---|---|---|---|---|---|
| 1 (Comparative) | Comparative Coupler 1 | 100 | 2.23 | 545 | 0.35 | 0.19 | 0.35 |
| 2 (Comparative) | Comparative Coupler 2 | 103 | 2.29 | 546 | 0.37 | 0.18 | 0.34 |
| 3 (Comparative) | Comparative Coupler 3 | 92 | 2.14 | 545 | 0.35 | 0.20 | 0.29 |
| 4 (Comparative) | Comparative Coupler 4 | 88 | 2.04 | 546 | 0.38 | 0.22 | 0.42 |
| 5 (Comparative) | Comparative Coupler 5 | 95 | 2.18 | 546 | 0.35 | 0.18 | 0.40 |
| 6 (Invention) | Exemplified Coupler 2 | 105 | 2.31 | 544 | 0.28 | 0.15 | 0.52 |
| 7 (Invention) | Exemplified Coupler 3 | 109 | 2.33 | 543 | 0.28 | 0.16 | 0.59 |
| 8 (Invention) | Exemplified Coupler 7 | 108 | 2.40 | 544 | 0.27 | 0.14 | 0.54 |
| 9 (Invention) | Exemplified Coupler 13 | 107 | 2.32 | 542 | 0.29 | 0.14 | 0.60 |
| 10 (Invention) | Exemplified Coupler 19 | 105 | 2.33 | 544 | 0.27 | 0.15 | 0.53 |

In this table, the relative sensitivity represents a sensitivity of each sample relative to the sensitivity of Sample-1 which is regarded as 100; λmax represents a maximum wavelength of the spectral absorption of each sample; D (λs) represents a density in a wavelength 90 nm shorter than λmax when the spectral reflection density in the λmax is 1.0; and, on the other hand, D($\lambda_L$) represents a density in a wavelength 90 nm longer than the λmax. (See FIG. 1); in other words. D(λs)=D(λmax−90), D($\lambda_L$)=(λmax+90).

This means that the greater a value of D(λs) is, the greater an irregular absorption in a blue region is; and the greater a value of D($\lambda_L$) is, the greater an irregular absorption in red region is.

An illustration of the above-mentioned D (λs) and D($\lambda_L$) is shown in FIG. 4. The respective absorption spectra of Samples-1, 4, 5, 6, 9 and 10 (in the form of wavelengths-density curves) are shown in FIGS. 1, 2 and 3. In FIG. 1, the absorption spectra of Sample-1 (Comparative sample) are illustrated by Curve 1, and those of Sample-2 (of the invention) are illustrated by Curve 2. In FIG. 2, the absorption spectra of Sample-4 (Comparative Sample) are illustrated by Curve 3, and those of Sample-9 (of the invention) are illustrated of Curve 4. In FIG. 3, the absorption spectra of Sample-5 (Comparative Sample) are illustrated by Curve 5, and those of Sample 10 (of the invention) are illustrated by Curve 6, respectively.

The light resistance thereof are indicated by a density of an area having an initial density of 1.0 obtained after each sample was exposed to a xenon fadometer for six days.

The structures of the comparative couplers shown in Table 1 are given below:

Comparative Coupler 1 {Exemplification (3) of Japanese Patent Application No. 243012/1984}

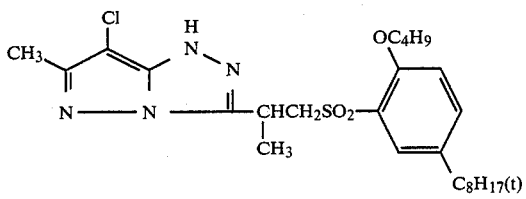

Comparative Coupler 2 {Exemplification (9) of Japanese Patent Application No. 243012/1984}

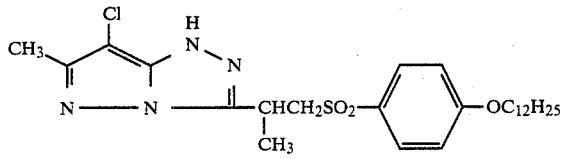

Comparative Coupler 3 {Exemplification (16) of Japanese Patent Application No. 243012/1984}

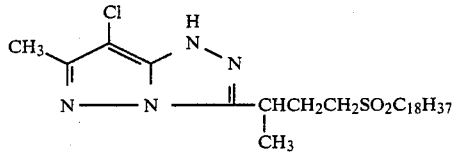

Comparative Coupler 4 {Exemplification (15) of Japanese Patent Application No. 243010/1984}

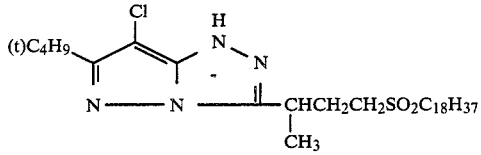

Comparative Coupler 5 {Exemplification (5) of Japanese Patent Application No. 243008/1984}

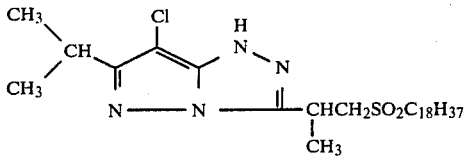

As is obvious from Table 1, it is understandable Lhat the samples (Samples 6 through 10) prepared by making use of the couplers of the invention are superior to the comparative samples (Samples 1 through 5) in color developability and light resistance. While, there is not much difference in λmax of between the samples, however, as are shown by the values of D(λs) and D($\lambda_L$), the irregular absorption in both of the blue-light region and the red-light region were considerably improved in the samples (Samples 6 through 10) relating to the invention more than in the comparative samples (Comparative Samples 1 through 5).

As are obvious from the abovegiven drawings, it can be understood that the silver halide photographic light-sensitive materials of the invention are less in the irregular absorption in a blue-light and red-light regions and excellent in color reproducibility, in comparison with the comparative silver halide photographic light-sensitive materials.

[Example-2]

The silver halide color photographic light-sensitive materials were prepared by coating the following layers in order on the polyethylene resin coated paper supports each containing an anatase type titanium oxide.

Hereinafter. an amount added means that per 100 $cm^2$.

(1) A layer containing 20 mg of gelatin; a blue-sensitive silver chlorobromide emulsion of 5 mg in terms of a content of silver; and 3 mg of dioctylphthalate coupler solvent in which 8 mg of yellow coupler and 0.1 mg of 2,5-di-t-octylhydroquinone were dissolved.

(2) An interlayer containing 12 mg of gelatin and 2 mg of the solvent for a dibutylphthalate ultraviolet-rays absorbing agent in which 0.5 mg of 2,5-di-t-octylhydroquinone and 4 mg of an ultraviolet-rays absorbing agent were dissolved.

(3) A layer containing 18 mg of gelatin. a green-sensitive silver chlorobromide emulsion of 4 mg in terms of the silver contents therein, and 2.5 mg of a solvent for dioctylphthalate couplers in which 5 mg of magenta coupler, 2 mg of an antioxidant and 0.2 mg of 2,5-di-t-octylhydroquinone were dissolved.

(4) An interlayer containing the same compositions as in the layer (2) above.

(5) A layer containing I6 mg of gelatin, a red-sensitive silver chlorobromide emulsion of 4 mg in terms of the silver contents, and 2.0 mg of a solvent for tricresylphosphate couplers in which 3.5 mg of cyan couplers and 0.1mg of 2,5 -di-t-octylhydroquinone were dissolved.

(6) A gelatin protective layer containing 9 mg of gelatin.

A coating assistant was added to each of the layers of from (1) to (6), and a gelatin linking agent was further added to each of the layers of from (4) to (6).

As for the ultraviolet-rays absorbing agent to be added in the layers (2) and (4), the mixture of UV-1 and UV-2 each having the structures shown below was used. As for the oxidation inhibitor to be added to the layer (3), di-t-pentylhydroquinone-di-octylether was used.

The abovedescribed multilayered light-sensitive materials were processed in the same manner as in Example-1. The yellow couplers, magenta couplers and cyan couplers used in each of the layers and the results thereof are shown in Table 2.

The magenta concentration obtained after eacn sample was exposed to white light was measured.

The relative sensitivity and light resistance thereof were measured in the same manner as in Example-1.

It is apparent from Table-2 that the light resistance of the dye image of the couplers of the invention is excellent and can also be further improved by making use of an ultraviolet-rays absorbing agent.

Ultraviolet-rays absorbing agents:

UV-1

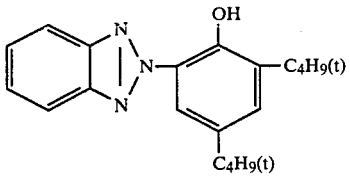

UV-2

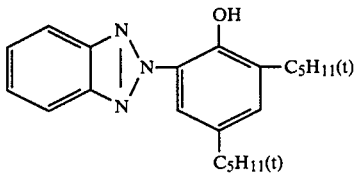

Y-couplers:

Y-1

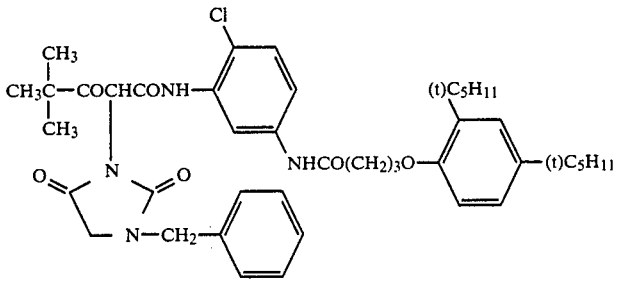

Y-2

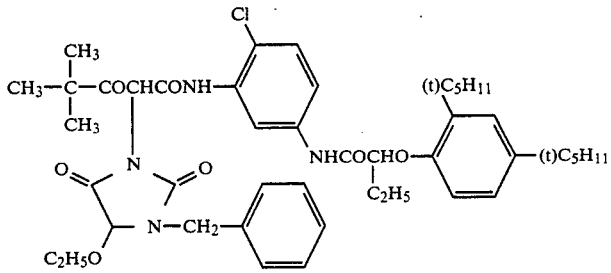

C-couplers:

C-1

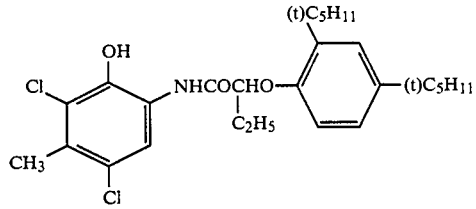

C-2

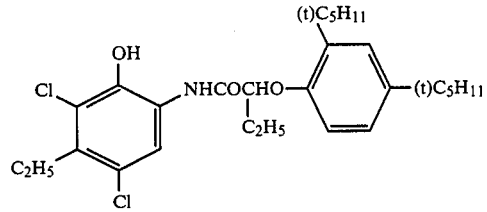

-continued

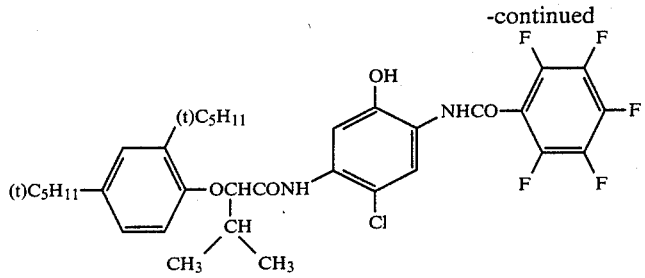

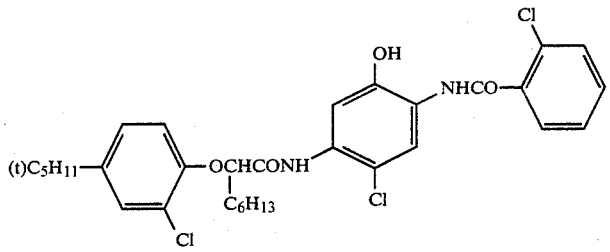

TABLE 2

| Sample No. | Layer (1) Y-coupler | Layer (3) M-coupler | Layer (5) C-coupler | Layer (5) Ultraviolet-rays absorbing agent | Relative sensitivity | Max. density | Light resistance | Remarks |
|---|---|---|---|---|---|---|---|---|
| 11 (Comparative) | Y-1 | Comparative Coupler (1) | C-1 | — | 100 | 2.25 | 0.22 | |
| 12 (Comparative) | Y-1 | Comparative Coupler (1) | C-1 | UV-1 UV-2 | 97 | 2.23 | 0.35 | 2 mg each of ultraviolet-rays absorbing agent were further added to Layer (5) |
| 13 (Invention) | Y-1 | Coupler of the Invention (12) | C-1 | — | 102 | 2.32 | 0.39 | |
| 14 (Invention) | Y-1 | Coupler of the Invention (12) | C-1 | UV-1 UV-2 | 100 | 2.38 | 0.50 | |
| 15 (Invention) | Y-2 | Coupler of the Invention (12) | C-2 | UV-1 UV-2 | 103 | 2.39 | 0.49 | |
| 16 (Invention) | Y-2 | Coupler of the Invention (12) | C-2 | UV-1 UV-2 | 103 | 2.36 | 0.57 | The same layer as Layer (2) was interposed between Layers (5) and (6) Sample 15. |
| 17 (Invention) | Y-1 | Coupler of the Invention (12) | C-3 | UV-1 UV-2 | 105 | 2.39 | 0.48 | |
| 18 (Invention) | Y-1 | Coupler of the Invention (12) | C-3 | UV-1 UV-2 | 102 | 2.38 | 0.56 | The same layer arrangement as that of Sample 16. |
| 19 (Invention) | Y-2 | Coupler of the Invention (12) | C-4 | UV-1 UV-2 | 106 | 2.37 | 0.47 | |
| 20 (Invention) | Y-2 | Coupler of the Invention (12) | C-1 | UV-1 UV-2 | 103 | 2.40 | 0.47 | |
| 21 (Invention) | Y-1 | Coupler of the Invention (11) | C-1 | UV-1 UV-2 | 102 | 2.34 | 0.51 | |

[Example-3]

As shown in Table 3, each of the magenta couplers and the comparative couplers were taken each in an amount of 0.1 mole per mole of the silver used. Tricresylphosphate in an amount of one part by weight of the couplers and ethyl acetate in an amount of three parts by weight thereof were added thereto. The resulted matters were completely dissolved by heating at 60° C., respectively. The resulted solutions each were mixed with 1200 ml of an aqueous solution of 5% gelatin containing 120 ml of an aqueous solution of alkylnaphthalene sulfonate, Alkanol B manufactured by DuPont, and the resulted mixtures were emulsified and dispersed by means of a ultrasonic homegenizer, so that the emulsified matters were obtained, respectively. Thereafter, the resulted dispersed liquids each were added to 4 kg of green-sensitive silver iodobromide containing silver iodide of 6 mole, % and 120 ml of a solution (water:methanol=1:) of 2% 2-bis(vinylsulfonyl)ethane were added thereto to serve as a hardener. The resulted emulsions each were coated on the respective sublayered transparent polyester bases and dried. so that Sample No. 22 to No. 36 were prepared, respectively. (The amount of silver coated: 20 mg/100Cm$^2$).

The samples thus obtained were exposed to light through wedges in an ordinary method, and the following developing steps were applied thereto, respectively. The results therefrom are shown in Table 3.

| <Developing Steps> | | | |
|---|---|---|---|
| 1. Color developing | 38° C. | 3 min. | 15 sec. |
| 2. Bleaching | 38° C. | 6 | 30 |
| 3. Washing | 38° C. | 3 | 15 |
| 4. Fixing | 38° C. | 6 | 30 |
| 5. Washing | 38° C. | 3 | 15 |
| 6. Stabilizing | 38° C. | 3 | 15 |

The composition of the processing liquids used in the above-mentioned steps are shown below:

| | |
|---|---|
| <Composition of Color Developer> | |
| Sodium nitrilotriacetic acid | 1.0 g |
| Sodium sulfite | 4.0 g |
| Sodium carbonate | 30.0 g |
| Potassium bromide | 1.5 g |
| Hydroxylamine sulfate | 2.5 g |
| 4-(N—ethyl-N—(3-hydroxyethylamino)-2-methyl-aniline sulfate | 4.5 g |
| Add water to make | 1 liter |
| pH value | 10.02 |
| <Composition of Bleaching Agent> | |
| Ammonium bromide | 160.0 g |
| Aqueous ammonia (28%) | 25.0 g |
| Iron sodium ethylenediaminetetraacetate | 130.0 g |
| Glacial acetic acid | 14.0 ml |
| Add water to make | 1 liter |
| <Composition of Fixer> | |
| Sodium tetrapolyphosphate | 2.0 g |
| Sodium sulfite | 4.0 g |
| Ammonium thiosulfate (70%) | 160.0 ml |
| Sodium hydrogensulfite | 5.0 g |
| Add water to make | 1 liter |
| <Composition of Stabilizer> | |
| Formalin | 10.0 ml |
| Add water to make | 1 liter |

TABLE 3

| Sample No. | Coupler Used | Relative sensitivity | Max. Density | Light Resistance |
|---|---|---|---|---|
| 22 (comparative) | Comparative Coupler 1 | 100 | 2.42 | 0.31 |
| 23 (comparative) | Comparative Coupler 2 | 101 | 2.47 | 0.32 |
| 24 (comparative) | Comparative Coupler 3 | 91 | 2.37 | 0.24 |
| 25 (comparative) | Comparative Coupler 4 | 87 | 2.18 | 0.39 |
| 26 (comparative) | Comparative Coupler 5 | 92 | 2.33 | 0.38 |
| 27 (Invention) | Exemplified Coupler 1 | 106 | 2.64 | 0.53 |
| 28 (Invention) | Exemplified Coupler 4 | 108 | 2.63 | 0.55 |
| 29 (Invention) | Exemplified Coupler 5 | 109 | 2.58 | 0.56 |
| 30 (Invention) | Exemplified Coupler 6 | 105 | 2.49 | 0.58 |
| 31 (Invention) | Exemplified Coupler 8 | 107 | 2.63 | 0.51 |
| 32 (Invention) | Exemplified Coupler 9 | 106 | 2.54 | 0.50 |
| 33 (Invention) | Exemplified Coupler 10 | 104 | 2.63 | 0.53 |
| 34 (Invention) | Exemplified Coupler 14 | 103 | 2.50 | 0.57 |
| 35 (Invention) | Exemplified Coupler 18 | 105 | 2.50 | 0.57 |
| 36 (Invention) | Exemplified Coupler 20 | 103 | 2.51 | 0.56 |

As is obvious from the results shown in Table 3. it can be understood that any one of the Samples No. 27 through No. 36 prepared by making use of the couplers of the invention is superior to the comparative samples in both of color developability and light resistance.

Figure 1:
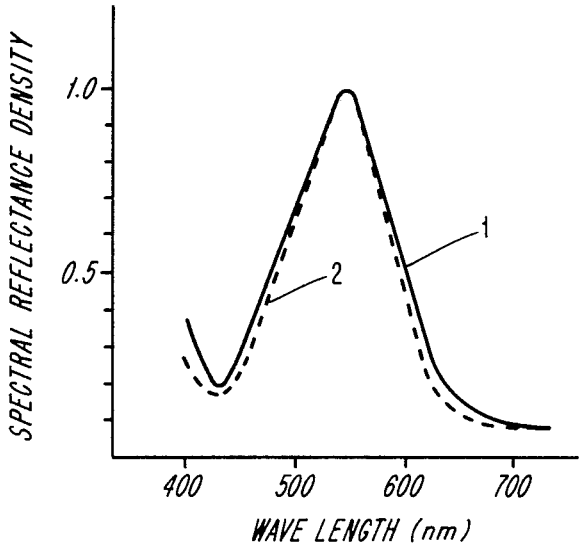
FIGS. 1, 2 and 3 each illustrate the absorption spectra (the wavelength-Spectral reflectance density curves) of the samples prepared in Example 1, respectively.
Figure 2:
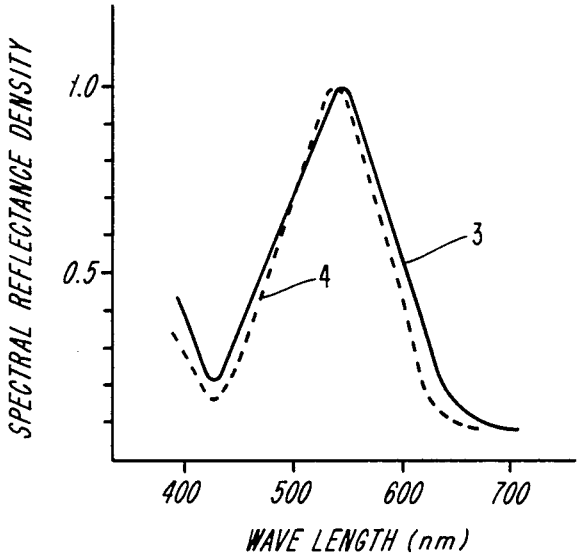
Figure 3:
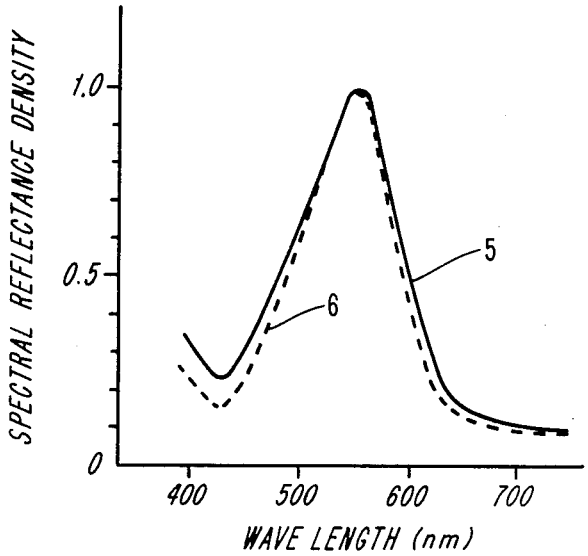
Figure 4:
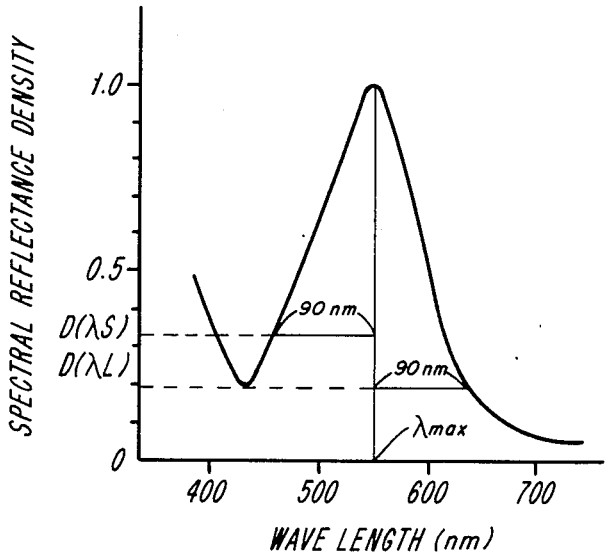
FIG. 4 is an illustration of D (λs) and D($\lambda_L$).

What is claimed is:

1. A silver halide photographic light-sensitive material characteristics a support bearing thereon at least one of silver halide emulsion layers. wherein at least one of said silver halide emulsion layers contains an 1H-pyrazolo[3,2-C-s-triazole magenta coupler substituted in the third position thereof by a group represented by the following Formula [I];

$$-R_1-SO_2-R_2 \qquad \text{Formula [I]}$$

wherein $R_1$ represents an alkylene group having not less than 3 carbon atoms in the straight-chained portion thereof, which links said $-SO_2-R_2$ the carbon atom in the third position of the nucleus of the 1H-pyrazolo[3,2-C]-s--triazole; and $R_2$ represents an aryl group.

2. The silver halide photographic light-sensitive material as claimed in claim 1, wherein said magenta coupler is represented by the following Formula [II];

Formula [II]

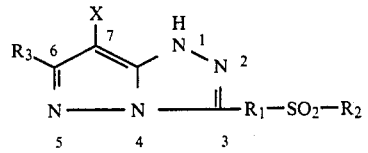

wherein X represents a group other than hydrogen, Which is to be splitted off through a reaction thereof with the oxidation products of a color developing agent used; $-R_1-SO_2-R_2$ is synonymous with the $-R_1-SO_2-R_2$ denoted in the Formula [I]; and $R_3$ represents an alkyl group. a cycloalkyl group, an aryl group or a heterocyclic ring.

3. The silver halide photographic light-sensitive material as claimed in claim 2, wherein the alkyl groups each represented by $R_3$ in the Formula [II] is a t-butyl group or a t-pentyl group.

4. The silver halide photographic light-sensitive material as claimed in claim 2, wherein the groups each represented by X in the Formula [II] is a halogen atom.

5. The silver halide photographic light-sensitive material as claimed in claim 2, wherein the aryl groups each represented by $R_2$ in the Formula [II] is a phenyl group.

6. The silver halide photographic light-sensitive material as claimed in claim 2, wherein said magenta couplers each is represented by the following formula;

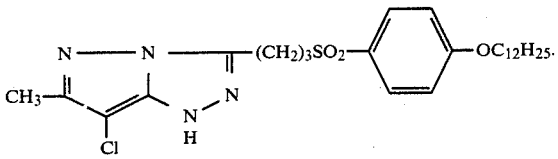

7. The silver halide photographic light-sensitive material as claimed in claim 2, wherein said magenta couplers each is represented by the following formula;

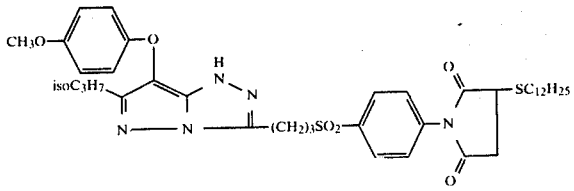

* * * * *

Disclaimer 4,695,533.—*Noritaka Nakayama; Satoshi Kawakatsu; Katsunori Katoh,* all of Hachioji; *Toshijumi Iijima,* Kokubunji; *Kenji Kumashiro,* Hachioji; *Hiroshi Kashiwagi,* Hino; *Koichi Hatta*; *Takashi Uchida,* both of Hachioji; *Hajime Wada,* Tokyo; *Fumio Ishii,* Akishima; *Satoshi Matsunaga,* Hino; *Yasuko Matsubara,* Akishima; *Kaoru Shinozaki,* Tokyo, all of Japan. SILVER HALIDE PHOTOGRAPHIC LIGHT-SENSITIVE MATERIAL. Patent dated Sept. 22, 1987. Disclaimer filed Nov. 10, 1988, by the assignee, Konica Corp.

The term of this patent subsequent to May 12, 2004, has been disclaimed.

[*Official Gazette May 15, 1990* ]